US009518551B2

(12) United States Patent
Martin et al.

(10) Patent No.: US 9,518,551 B2
(45) Date of Patent: Dec. 13, 2016

(54) LASER IGNITION SAFETY INTERLOCK SYSTEM AND METHOD

(71) Applicant: Ford Global Technologies, LLC, Dearborn, MI (US)

(72) Inventors: Douglas Raymond Martin, Canton, MI (US); Kenneth James Miller, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 857 days.

(21) Appl. No.: 13/870,327

(22) Filed: Apr. 25, 2013

(65) Prior Publication Data

US 2014/0324324 A1 Oct. 30, 2014

(51) Int. Cl.

| | |
|---|---|
| ***F02P 23/04*** | (2006.01) |
| ***F02N 15/10*** | (2006.01) |
| *F02N 11/08* | (2006.01) |
| *F02D 41/00* | (2006.01) |

(52) U.S. Cl.

CPC ..... *F02N 15/10* (2013.01); *F02P 23/04* (2013.01); *F02D 2041/0092* (2013.01); *F02N 11/0814* (2013.01)

(58) Field of Classification Search

CPC ..... F02N 15/10; F02N 11/0814; F02D 2041/0092; F02P 23/04

USPC ..... 701/103, 113

See application file for complete search history.

(56) References Cited

U.S. PATENT DOCUMENTS

| | | | | |
|---|---|---|---|---|
| 4,852,529 | A | 8/1989 | Vowles | |
| 6,796,278 | B2 | 9/2004 | Ryan, III | |
| 8,232,687 | B2 | 7/2012 | Stadler et al. | |
| 8,253,790 | B1 | 8/2012 | Trent et al. | |
| 8,297,248 | B2 | 10/2012 | Martin et al. | |
| 2003/0045867 | A1* | 3/2003 | Marchitto | A61B 5/411 606/9 |
| 2007/0253455 | A1* | 11/2007 | Stadler | H01S 3/005 372/38.09 |
| 2014/0149019 | A1* | 5/2014 | Martin | F02D 41/009 701/103 |
| 2015/0229102 | A1* | 8/2015 | Khan | H01S 5/0261 372/38.04 |

FOREIGN PATENT DOCUMENTS

GB 2441145 A * 2/2008 ..... F02D 35/022

OTHER PUBLICATIONS

Marshall, Laura, "Laser Car Ignition Dream Sparks Multiple Approaches," Photonics, http://www.photonics.com/Article.aspx?AID=51731, Sep. 2012, pp. 1-9, Accessed Oct. 14, 2013.

(Continued)

*Primary Examiner* — Stephen K Cronin
*Assistant Examiner* — Arnold Castro
(74) *Attorney, Agent, or Firm* — Julia Voutyras; Alleman Hall McCoy Russell & Tuttle LLP

(57) ABSTRACT

A safety interlock system and method is provided for a laser ignition system. The laser device can be disabled upon receiving an indication that the laser device has been removed from the cylinder. The removal can be inferred based on an estimated distance between the cylinder piston and the laser ignition device.

20 Claims, 4 Drawing Sheets

(56) References Cited

OTHER PUBLICATIONS

Martin, Douglas Raymond, et al., "Laser Ignition and Misfire Monitor," U.S. Appl. No. 13/677,641, filed Nov. 15, 2012, 30 pages.
Martin, Douglas Raymond, et al., "Engine with Laser Ignition and Measurement," U.S. Appl. No. 13/689,601, filed Nov. 29, 2012, 44 pages.
Martin, Douglas Raymond, et al., "Engine with Laser Ignition and Measurement," U.S. Appl. No. 13/689,578, filed Nov. 29, 2012, 54 pages.
Martin, Douglas R. et al., "Laser Ignition and Misfire Monitor," U.S. Appl. No. 13/677,641, filed Nov. 15, 2012, 30 pages.
Martin, Douglas R. et al., "Laser Ignition System Based Diagnostics," U.S. Appl. No. 13/865,088, filed Apr. 17, 2013, 41 pages.
Martin, Douglas R. et al., "Laser Ignition System Based Diagnostics," U.S. Appl. No. 13/865,089, filed Apr. 17, 2013, 40 pages.
Martin, Douglas R. et al., "Laser Ignition System Based Diagnostics," U.S. Appl. No. 14/152,811, filed Jan. 10, 2014, 85 pages.
Martin, Douglas R. et al., "Laser Ignition System Based Diagnostics," U.S. Appl. No. 14/152,833, filed Jan. 10, 2014, 85 pages.
Martin, Douglas R. et al., "Laser Ignition System Based Diagnostics," U.S. Appl. No. 14/152,851, filed Jan. 10, 2014, 84 pages.
Martin, Douglas R. et al., "Engine With Laser Ignition and Measurement," U.S. Appl. No. 13/689,601, filed Nov. 29, 2012, 44 pages.
Martin, Douglas R. et al., "Engine With Laser Ignition and Measurement," U.S. Appl. No. 13/689,578, filed Nov. 29, 2012, 54 pages.
Anonymous, "Variable Outputsolid Propellant Inflator," IPCOM No. 000032345, Published Nov. 2, 2004, 3 pages.

* cited by examiner

LASER IGNITION SAFETY INTERLOCK SYSTEM AND METHOD

FIELD

The present application relates to methods and systems for improving safety of using a laser ignition system.

BACKGROUND AND SUMMARY

Engine systems on vehicles, such as hybrid electric vehicles (HEV) and vehicles configured for idle-stop operations, may be configured with a laser ignition system. In addition to initiating cylinder combustion, the laser ignition system may be used during engine starting to accurately determine the position of a piston in each cylinder, enabling an appropriate cylinder to be selected for a first combustion event. As such, this improves the engine's ability to restart.

Laser ignition systems may be periodically diagnosed. In one example, a service technician may remove the laser device to test the system. However, the inventors herein have recognized that potential injuries may occur during such diagnostics. As an example, the laser pulse output by the device during the diagnostics can pose a serious eye safety hazard. For example, if an inexperienced mechanic, unfamiliar with the high peak-power of the laser device, probes or tampers with the laser ignition device during the testing, the laser output can strike someone in the eye, potentially causing irreparable damage.

In one example, some of the above issues may be addressed by a laser ignition safety interlock system and method. The method may comprise adjusting operation of an engine laser ignition device based on a position of the device with respect to an engine cylinder. In this way, the laser device of an engine ignition system can be disabled when taken out of the cylinder.

For example, a laser ignition system may be used to emit high power laser pulses to ignite a cylinder air-fuel mixture during combusting conditions. During non-combusting conditions, the laser ignition system may be used to determine cylinder piston position by emitting low power laser into the cylinder to determine a distance of a piston with respect to the laser ignition device. For example, the distance may be inferred based on a time elapsed since the laser pulse is emitted and the laser pulse is detected. In addition to using the piston position information to select an engine cylinder for an engine restart procedure, the estimated distance may also be used to determine if the laser ignition device has been removed from the cylinder. Specifically, if the inferred distance between the piston and the laser ignition device is greater than a threshold (wherein the threshold is based on the cylinder length or the maximum distance possible between the piston and the device, such as when the piston is at BDC), it may be concluded that the laser device has been removed from the cylinder (e.g., for testing). Accordingly, the laser ignition device is disabled such that no laser pulse is emitted from the device even when requested. The laser ignition device may be re-enabled only upon confirmation that the laser ignition device has been re-installed into the cylinder (such as following a reset input from the operator). In this way, a safety interlock is provided for the laser ignition device which reduces the potential for injuries incurred when the laser device is handled outside of a cylinder.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
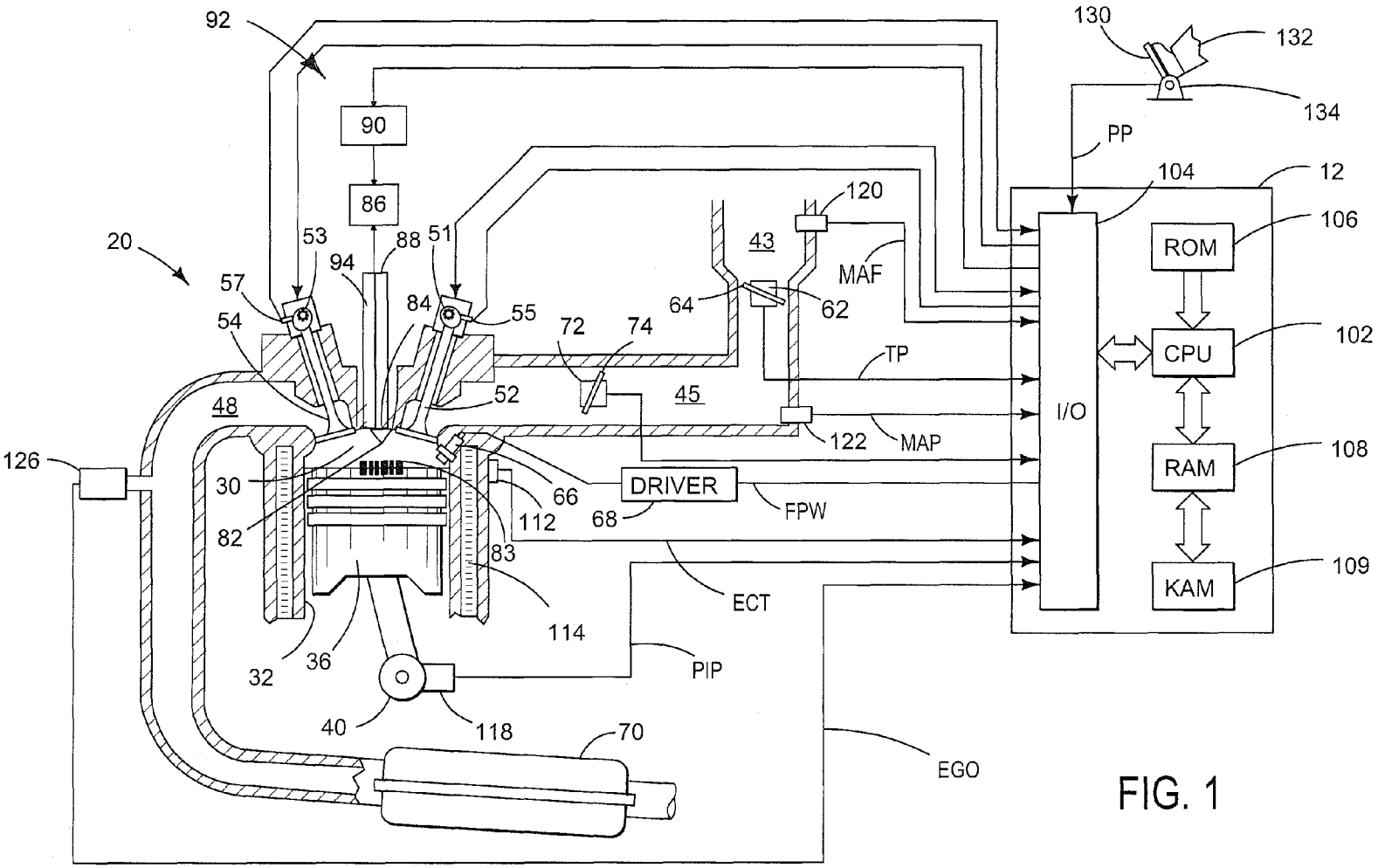
FIG. 1 shows a schematic diagram of an example internal combustion engine configured with a laser ignition system.
Figure 2:
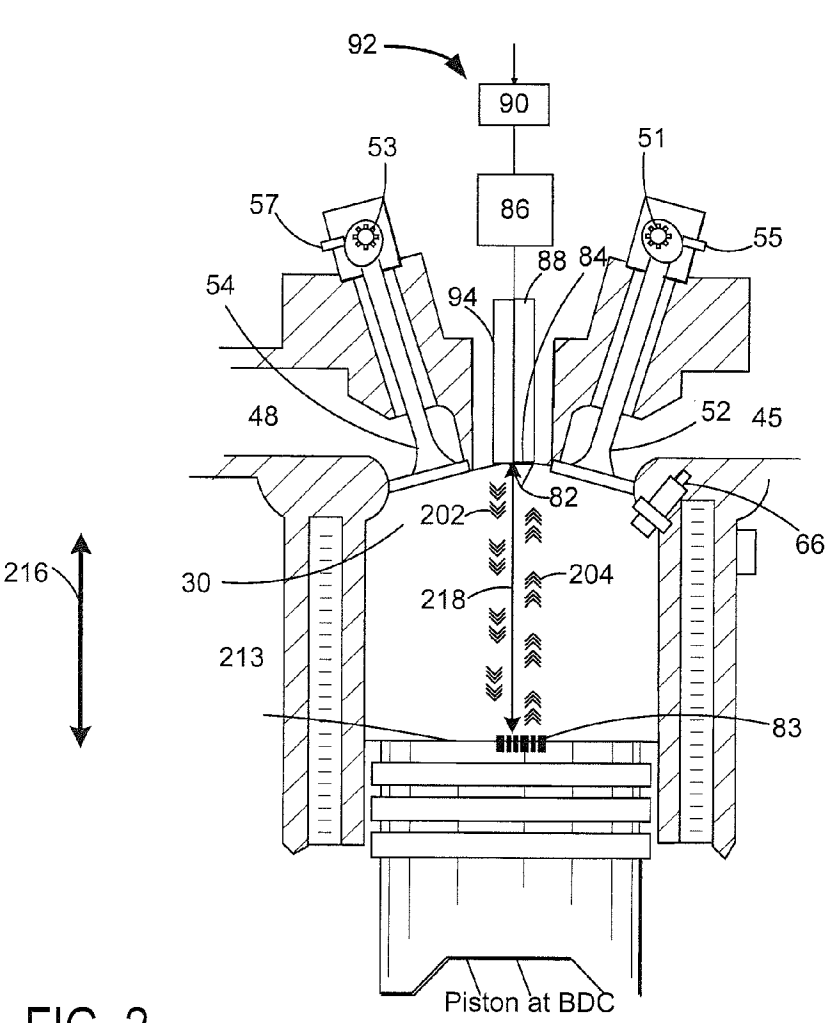
FIG. 2 shows an example of laser light pulse emission and detection in an engine cylinder to determine if a piston is within a normal range of the laser ignition device.
Figure 2:
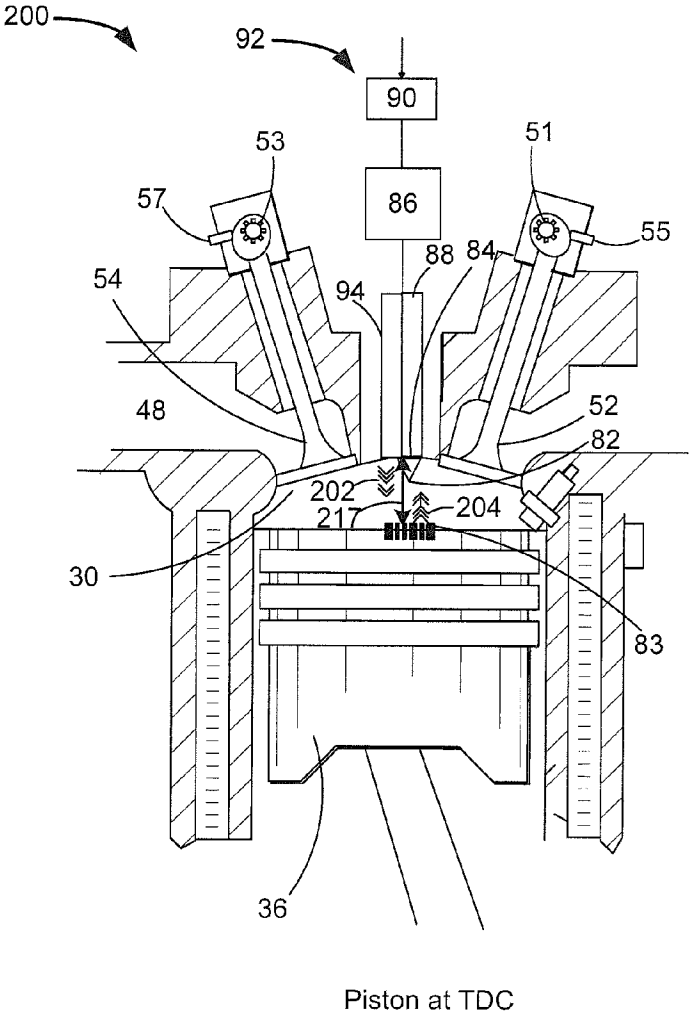

Methods and systems are provided for disabling a laser ignition device in an engine system configured with a laser ignition system, such as the engine system of FIG. 1. During non-combusting conditions, piston position determination may be performed by emitting low power laser pulses into a cylinder from the laser ignition system and detecting their reflection off a top surface of the cylinder piston, such as shown in FIG. 2. A controller may be configured to perform a control routine, such as the routine of FIG. 3, to transition operation of the laser ignition device between a high power mode during combusting conditions (to ignite a cylinder air/fuel mixture), and a low power mode during non-combusting conditions to estimate the position of a cylinder piston and a distance of the piston from the laser device. The controller may confirm installation of the laser ignition device in the cylinder based on the estimated position estimate and disable the device during conditions when it has been removed from the cylinder. FIG. 4 illustrates an example disabling of a laser ignition device upon removal from an engine cylinder.

Referring to FIG. 1, the figure shows a schematic diagram of an example cylinder of multi-cylinder internal combustion engine 20. Engine 20 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion cylinder 30 of engine 20 may include combustion cylinder walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Combustion cylinder 30 may receive intake air from intake manifold 45 via intake passage 43 and may exhaust combustion gases via exhaust passage 48. Intake manifold 45 and exhaust passage 48 can selectively communicate with combustion cylinder 30 via respective intake valve 52 and exhaust valve 54. In some embodiments, combustion cylinder 30 may include two or more intake valves and/or two or more exhaust valves.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. To enable detection of cam position, cam actuation systems 51 and 53 should have toothed wheels. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion cylinder 30 for injecting fuel directly therein in proportion to the pulse width of signal FPW received from controller 12 via electronic driver 68. In this manner, fuel injector 66 provides what is known as direct injection of fuel into combustion cylinder 30. The fuel injector may be mounted on the side of the combustion cylinder or in the top of the combustion cylinder, for example. Fuel may be delivered to fuel injector 66 by a fuel delivery system (not shown) including a fuel tank, a fuel pump, and a fuel rail. In some embodiments, combustion cylinder 30 may alternatively or additionally include a fuel injector arranged in intake passage 43 in a configuration that provides what is known as port injection of fuel into the intake port upstream of combustion cylinder 30.

Intake passage 43 may include a charge motion control valve (CMCV) 74 and a CMCV plate 72 and may also include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). In this manner, throttle 62 may be operated to vary the intake air provided to combustion cylinder 30 among other engine combustion cylinders. Intake passage 43 may include a mass air flow sensor 120 and a manifold air pressure sensor 122 for providing respective signals MAF and MAP to controller 12.

Exhaust gas sensor 126 is shown coupled to exhaust passage 48 upstream of catalytic converter 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a $NO_x$, HC, or CO sensor. The exhaust system may include light-off catalysts and underbody catalysts, as well as exhaust manifold, upstream and/or downstream air/fuel ratio sensors. Catalytic converter 70 can include multiple catalyst bricks, in one example. In another example, multiple emission control devices, each with multiple bricks, can be used. Catalytic converter 70 can be a three-way type catalyst in one example.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 109, and a data bus. The controller 12 may receive various signals and information from sensors coupled to engine 20, in addition to those signals previously discussed, including measurement of inducted mass air flow (MAF) from mass air flow sensor 120; engine coolant temperature (ECT) from temperature sensor 112 coupled to cooling sleeve 114; in some examples, a profile ignition pickup signal (PIP) from Hall effect sensor 118 (or other type) coupled to crankshaft 40 may be optionally included; throttle position (TP) from a throttle position sensor; and absolute manifold pressure signal, MAP, from sensor 122. The Hall effect sensor 118 may optionally be included in engine 20 since it functions in a capacity similar to the engine laser system described herein. Storage medium read-only memory 106 can be programmed with computer readable data representing instructions executable by processor 102 for performing the methods described below as well as variations thereof.

Laser system 92 includes a laser exciter 88, a laser detection system 94, and a laser control unit (LCU) 90. LCU 90 causes laser exciter 88 to generate laser energy. LCU 90 may receive operational instructions from controller 12. Laser exciter 88 includes a laser oscillating portion 86 and a light converging portion 84. The light converging portion 84 converges laser light generated by the laser oscillating portion 86 on a laser focal point 82 of combustion cylinder 30.

Laser system 92 is configured to operate in more than one capacity with the timing of each operation based on engine position of a four-stroke combustion cycle. For example, laser energy may be utilized for igniting an air/fuel mixture during a power stroke of the engine, including during engine cranking, engine warm-up operation, and warmed-up engine operation. Fuel injected by fuel injector 66 may form an air/fuel mixture during at least a portion of an intake stroke, where igniting of the air/fuel mixture with laser energy generated by laser exciter 88 commences combustion of the otherwise non-combustible air/fuel mixture and drives piston 36 downward. Laser energy may also be used to determine an engine position, including a position of various cylinder pistons while an engine is at rest (such as during an idle-stop). The piston position information may be used to select an engine cylinder in which to initiate combustion during an engine restart. As elaborated below, the laser energy may also be used to gauge a distance between the laser device and the piston. The estimated distance may be used to infer whether the laser device is installed in the cylinder head, or removed there-from.

LCU 90 may direct laser exciter 88 to focus laser energy at different locations of the cylinder depending on the operating conditions. For example, the laser energy may be focused at a location away from cylinder wall 32 within the interior region of cylinder 30. In one example, the location includes near top dead center (TDC) of a power stroke when the laser energy is used to ignite an air-fuel mixture. In another example, the location includes the top surface of a cylinder piston when the energy is used for piston position and laser device installation determination. Further, the laser pulse may read an identifying mark on the surface of the piston. For example, each piston may contain a unique barcode on the top surface that includes identifying information corresponding to the respective cylinder. During piston position determination, a laser pulse may be focused at barcode 83 located on piston 36 in order to determine if laser ignition device 88 is installed in the cylinder. Since each barcode is unique to the piston of the given cylinder, an incorrect reading of the barcode may indicate the laser ignition device is removed from that particular cylinder, and accordingly, steps may be taken to disable the device. In one example, the barcode may be a permanent part of the piston, since paper would burn off. In another example, the bar code may be included in the piston casting or stamped in after casting. Alternately, a shape or alphanumeric characters could be stamped on the piston head, which could be viewed by the optical device and processed to confirm correct laser installation.

FIG. 2 shows an example operation of the laser system 92 that includes a laser exciter 88, detection system 94, and LCU 90. LCU 90 causes laser exciter 88 to generate and emit pulses of laser energy which are directed towards top surface 213 of piston 36, specifically towards barcode 83, as shown at 202. LCU 90 may receive operational instructions, such as a power mode, from controller 12. For example, during ignition conditions, LCU 90 may be operated in a higher power mode such that laser system 92 emits laser pulses of higher energy intensity frequently to ignite a cylinder air/fuel mixture. As another example, during non-combusting conditions, LCU 90 may be operated in a lower power mode such that laser system 92 emits lower power pulses to precisely measure the distance from the top of the piston to the top of the cylinder. In one example, frequency-modulation of the laser pulse with a repetitive linear frequency ramp may be used during the lower power mode to determine positions of one or more pistons of the engine. A detection sensor 94 located in the top of the cylinder may be configured as part of the laser system and may receive return pulse 204 reflected from top surface 213 of piston 36.

The controller may infer the position of the piston based on a time elapsed since emission of the laser pulse from the laser ignition device into the cylinder and detection of the reflected laser pulse (following reflection off of the piston) by the detector. A time-to-distance algorithm may convert the time taken to a distance traveled to determine the position of the piston accurately. As such, the distance between the piston and the laser ignition device may vary within a range 216 having an upper limit 218 corresponding to a largest possible distance (that occurs when the piston is at BDC) and a lower limit 217 corresponding to a smallest possible distance (that occurs when the piston is at TDC). For example, when the piston is positioned at TDC, the time elapsed since emission of a laser pulse from the laser ignition device into the cylinder and detection of the laser following reflection off of the piston will be shorter, and the distance will also be shorter. However, when the piston is positioned at BDC, the time elapsed will be longer and the corresponding distance will also be longer. In another example, the range 216 corresponds to the length of the cylinder.

In some examples, the location of the piston and the distance to the piston may be determined by frequency modulation methods using frequency-modulated laser beams with a repetitive linear frequency ramp. Alternatively, phase shift methods may be used to determine the distance. By observing the Doppler shift or by comparing sample positions at two different times, piston position, velocity and engine speed information (RPM measurement) can be inferred. The position of intake valve 52 and exhaust valve 54 may then be determined by position sensors 55 and 57, respectively, in order to identify the actual position of the engine. Once the position and/or velocity of each piston in the engine have been determined, a controller, e.g., controller 12, may process the information to determine a positional state or operational mode of the engine. Such positional states of the engine, based on piston positions determined via lasers, may further be based on geometry of the engine. For example, a positional state of the engine may depend on whether the engine is a V-engine or an inline engine. Once the relative engine position signals indicate that the engine has been synchronized, the system information may also be used to determine crank angle and cam position in order to find information for TDC and BDC for each piston in an engine.

As such, while the laser ignition device is installed in the cylinder, the estimated piston position, and the estimated distance between the piston and the laser ignition device lies within range 216. However, if the laser ignition device is removed from the cylinder, the estimated piston position, and the estimated distance between the piston and the laser ignition device, may exceed range 216. A controller may compare the time taken to detect a reflected laser pulse to a threshold (or compare the distance between the laser device and the piston to a threshold) in order to determine whether the laser ignition device is installed or removed from the cylinder. In one example, during diagnostic testing of the laser ignition device, a service technician may remove the laser device from the cylinder. If the estimated distance is higher than the threshold, where the threshold is based on the length of the cylinder, or based on the distance to a piston when the piston is at BDC, it may be determined that the laser ignition device has been removed from the cylinder. Likewise, if the estimated time taken to detect the reflected laser pulse is longer than a time taken for a reflected laser pulse to be detected when the piston is located at BDC, it may be determined that removal of the laser ignition device has occurred.

In one example, when the laser device is located in the cylinder, due to the distance of the laser system 92 to the top surface of piston 213 being smaller, detection of a laser pulse by the detection system 94 may occur in the picosecond time range. In comparison, when the laser device is located outside the cylinder, due to the distance of the laser system 92 to the top surface of piston 213 being larger than distance range 216, detection of the laser pulse by the detection system 94 may occur in a time range much greater than the optimum range expected, for example, in the nanosecond range. In one example, a 1 nanosecond value may be adopted as the reference value or threshold time for comparison to the measured time difference to identify if the laser is outside the cylinder. Thus, if a laser pulse is emitted and the reflected pulse takes longer than 1 nanosecond to be detected, it may be inferred that the laser ignition device of the corresponding cylinder has been removed.

Figure 3:
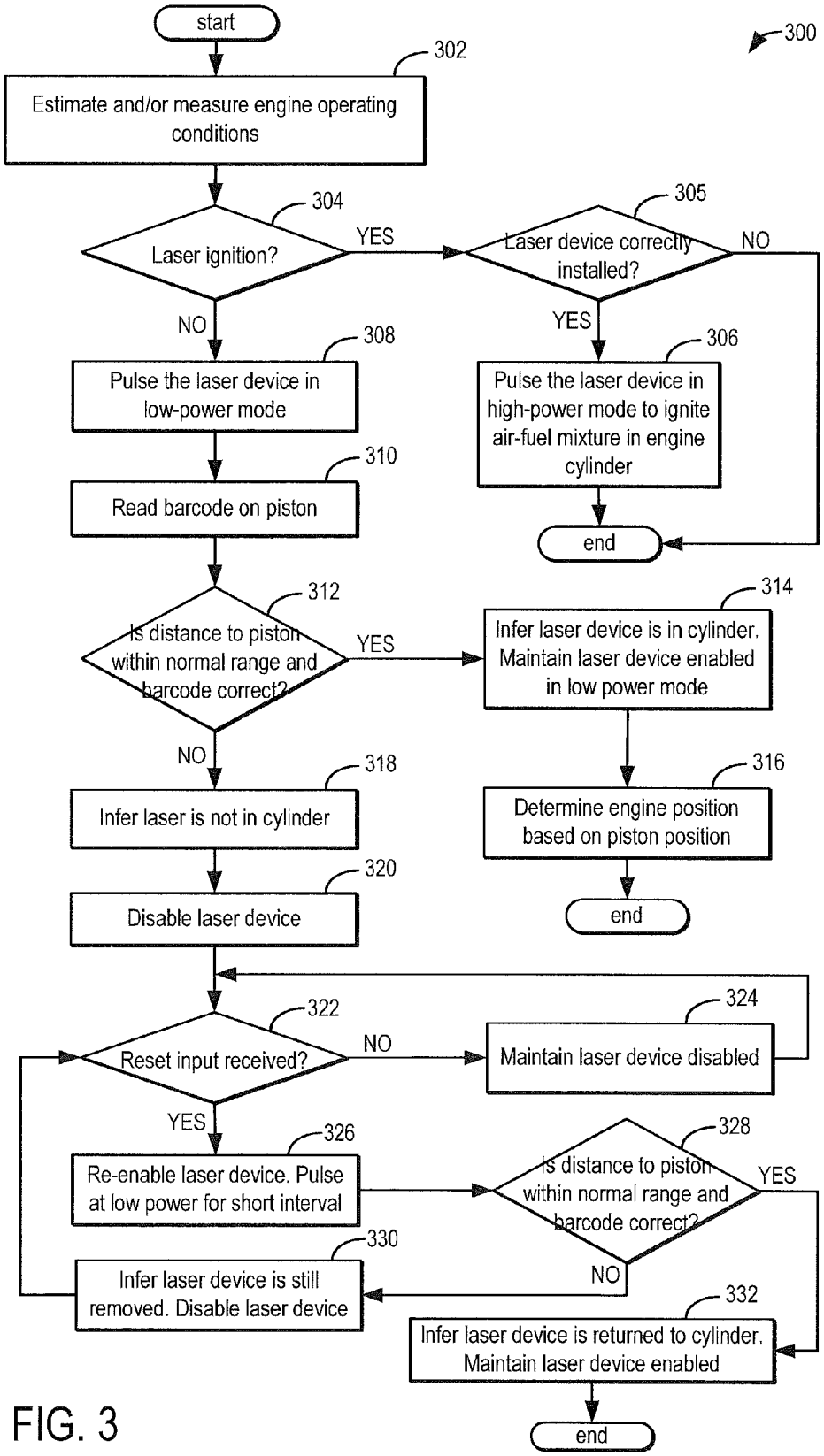
FIG. 3 shows a high level flow chart of a method for disabling a laser ignition device of a cylinder based on cylinder piston position.
Figure 4:
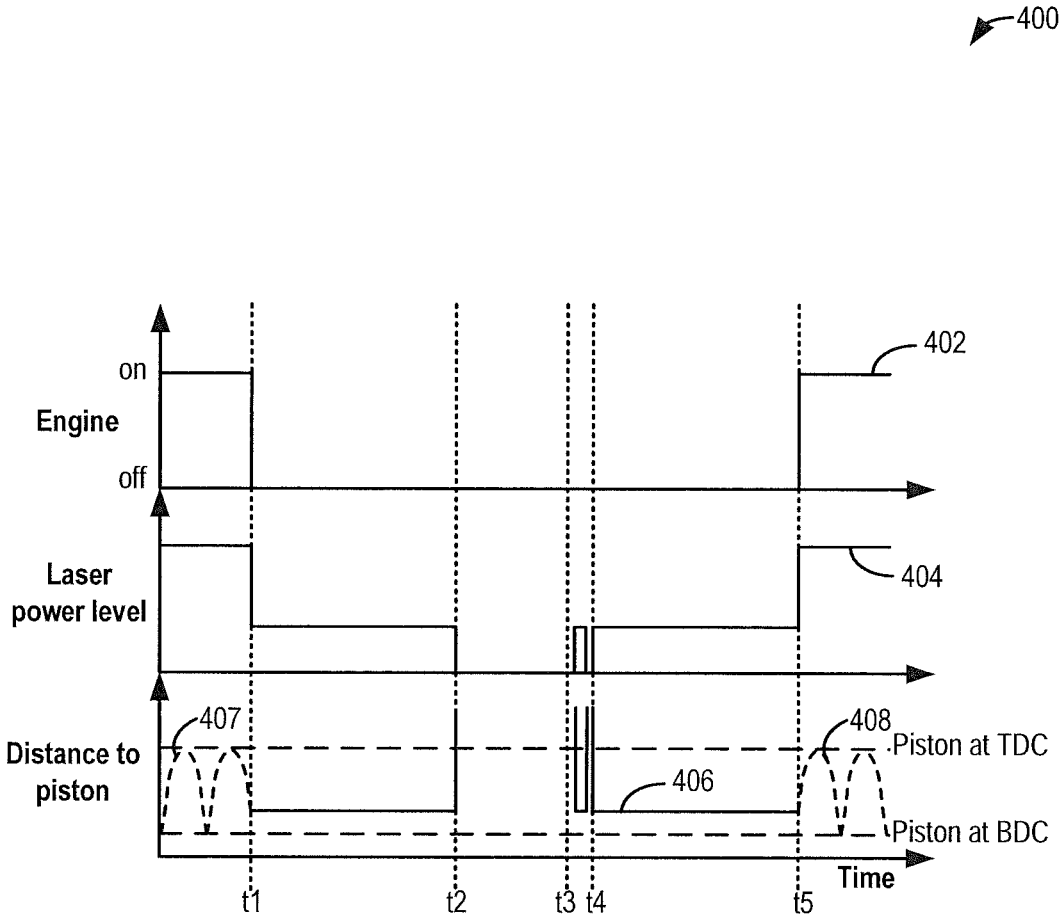
FIG. 4 shows an example adjustment to the power output of a laser ignition device based on cylinder piston position.

FIG. 3 shows an example method for adjusting the operation of a laser ignition device coupled to an engine cylinder based on an inferred position of the device with respect to a piston of the cylinder. In particular, the method involves operating a laser system to determine whether a laser ignition device is coupled to the cylinder or removed from the cylinder. The device may be accordingly enabled or disabled. As such, the laser ignition device may also be operated to ignite an air-fuel mixture in the cylinder during a combustion event.

At 302, the method includes estimating and/or inferring engine operating conditions. These may include, for example, engine speed, engine temperature, catalyst temperature, boost level, MAP, MAF, ambient conditions (temperature, pressure, humidity, etc.). At 304, the method includes determining if laser ignition is requested. For example, if engine combusting conditions exist, it may be determined that laser ignition is requested. If at 304, it is determined that a laser ignition is to be performed, then at 305, it is confirmed that the laser device is correctly installed in the cylinder. In one example, correct installation may be confirmed based on the laser device correctly reading the barcode on the piston. For example, the laser device may scan across the designated barcode region. As the alternating dark and light regions reflect in a sequence related to the width of the bars, the photodetector is able to identify the sequence of the reflected light and provide authentication of installation. If each cylinder is provided with a different bar code, then the cylinder read can also be identified. In this way, if a laser is re-installed in the wrong cylinder, the control system can provide an error code or message specifying the laser is in the wrong cylinder. If the system uses a CCD camera, alphanumeric characters may read off the top of the piston and processed in a similar way to the barcode.

If correct installation is not confirmed, the routine ends. Only upon confirming correct installation of the laser device, at 306, the laser ignition device may be operated in a higher power mode with high power pulses emitted from the laser ignition device into a cylinder of the engine. The high power laser pulses may be used to ignite a cylinder air-fuel mixture and thereby initiate cylinder combustion.

If laser ignition conditions are not confirmed at 304, then at 308, the laser ignition device may be operated in a lower power mode with low power pulses emitted from the device towards an interior of the cylinder. For example, the laser ignition device may be operated in the lower power mode during non-combusting conditions while an engine is shut-down or deactivated (e.g., placed in idle-stop). The lower power mode may be used to determine a piston position in the cylinder. For example, before a first combustion event from rest, the laser ignition device may be operated at a lower power to estimate the distance between the laser ignition device and a piston of the cylinder. The low power laser pulse may be emitted towards the interior of the cylinder. The emitted laser pulse is then reflected off the top surface of the piston and the reflected laser pulse is detected by a laser detection device. A time elapsed between the emitting of the laser pulse and the detecting of the laser pulse is measured. The time value is then converted to a distance value to determine the distance between the laser ignition device and the piston of the cylinder, and thereby infer a position of the piston in the cylinder. By determining the position of the piston in the cylinder, an engine position including a cylinder stroke may be determined. The controller may use the engine position and piston position data gathered during the non-combusting conditions to select a cylinder for a first combustion event during a subsequent engine start. For example, the piston position and engine position data may be used to identify a first firing cylinder in which to initiate combustion during engine reactivation from idle-stop conditions.

At 310, the laser ignition device may also read a barcode located on the top surface of the piston. For example, the low power pulse may reflect off and read barcode 83 (as shown in FIG. 2). As such, since the barcode for each piston is unique to the corresponding cylinder, by reading the barcode, the position of a specific piston may be determined, and the identity of the corresponding cylinder may be confirmed. In addition, as elaborated below, in the event that a laser ignition device of a cylinder has been removed, the barcode data may be used to identify the cylinder from which the laser ignition device has been removed.

To read the bar code, the laser device may scan across the designated barcode region. As the alternating dark and light regions reflect in a sequence related to the width of the bars, the photodetector is able to identify the sequence of the reflected light and provide authentication of installation. If each cylinder is provided with a different bar code, then the cylinder read can also be identified. In this way, if a laser is re-installed in the wrong cylinder, the control system can provide an error code or message specifying the laser is in the wrong cylinder. If the system uses a CCD camera, alphanumeric characters may read off the top of the piston and processed in a similar way to the barcode.

Applicants have recognized that in addition to providing information regarding cylinder piston position, the estimated distance between the laser ignition device and the piston can also be used to infer if the laser ignition device has been removed from the cylinder (or decoupled from the cylinder head). In particular, while the laser ignition device is installed in the cylinder, the piston position may be at any position within a range defined by an upper limit and a lower limit. As discussed at FIG. 2, the upper limit of the range corresponds to a position when the piston is at BDC and the distance between the piston surface and the laser device is largest, while the lower limit of the range corresponds to a position when the piston is at TDC and the distance between the piston surface and the laser device is smallest. In comparison, if the laser ignition device is removed from the cylinder, the distance may be outside of the expected range. As an alternate example, while the laser ignition device is installed in the cylinder, the inferred piston position may be within a threshold distance of the laser ignition device wherein the threshold is based on a distance between the laser device and the piston when the piston is at BDC and a distance when the piston is at TDC. In comparison, if the laser ignition device is removed from the cylinder, the inferred piston position may be greater than the threshold distance.

Further still, since the inferred piston position is based on a time elapsed since the emitting of a laser pulse from the laser ignition device into the engine cylinder and detection of the laser pulse (by a detector of the laser ignition system) following reflection off the top surface of the piston, while the laser ignition device is installed in the cylinder, the time taken to detect the laser pulse may be within a threshold duration wherein the threshold duration is based on time elapsed when the piston is at BDC and time elapsed when the piston is at TDC. In comparison, if the laser ignition device is removed from the cylinder, the time taken to detect the laser pulse may be greater than the threshold duration.

At 312, it is determined if the distance from the laser ignition device to the piston is within a normal or expected range and if the barcode is correct. Alternatively, it may be determined if the distance is within a threshold distance wherein the threshold distance is based on a length of the cylinder. If the distance is within the expected range (e.g., within a threshold distance), at 314, it may be inferred that the laser ignition device is installed in the cylinder (that is, the device has not been removed). In response to the determination that the laser ignition device is in the cylinder, the controller may maintain the laser device in the low power mode to continue emitting lower power pulses for estimating the position of a piston in the cylinder. At 316, an engine position may be determined based on the inferred piston position. For example, a cylinder stroke may be determined. The controller may use this data to select an engine cylinder in which to initiate a first combustion event when laser ignition conditions are subsequently confirmed. As such, when ignition conditions are confirmed, the laser ignition device is shifted to the higher power mode, as previously discussed at 306.

At 318, if the estimated distance of the piston is outside the expected range, or larger than the threshold distance, it is inferred that the laser ignition device has been removed from the cylinder. For example, the laser ignition device may have been removed by a service technician during a diagnostic procedure to test the laser device. As a result of the inferred position of the device being out of the cylinder, at 316, the routine includes disabling operation of the laser ignition device. For example, the power output of the laser pulses emitted by the laser ignition device may be substantially reduced. As another example, the disabling includes emitting no laser pulse from the laser ignition device when a request for laser operation is received. The disabling may be performed using hardware and/or software adjustments. Hardware adjustments may include, for example, operating a switch (e.g., circuit breaker) to interrupt current flow to the laser ignition device, thereby disabling the laser device. Software adjustments may include, for example, operating code stored on the controller's memory that (temporarily) causes no laser pulse to be emitted in response to operator request for laser pulse emission.

As such, the laser ignition device is maintained in the disabled mode until an indication of installation of the device in the cylinder is received, at which point the laser ignition device may be re-enabled. Specifically, at 322 it may be determined if a reset input has been received from the operator. In one example, the service technician may press a reset button, thereby providing a reset input, after completing diagnosis of the laser ignition device and re-installing the laser device in the cylinder. If a reset input is not confirmed, at 324, the method includes maintaining the laser ignition device disabled. Herein, it may continue to be inferred that the laser device has been removed from the cylinder and the laser device may continue to remain disabled to reduce the possibility of injuries.

If a reset input is confirmed, then at 326, the laser device may be re-enabled and a short low power pulse may be emitted. The short low power pulse may be emitted to confirm that the laser ignition device has been reinstalled into the cylinder. In addition, the lower power pulse may be detected, and based on a time taken to detect the pulse, a position of the piston in the cylinder, and a distance of the laser device from the piston may be inferred, as previously discussed at 312. At 328, following the reset input, it may be determined if the distance between the piston and the laser ignition device of the cylinder is within the expected range (e.g., within the threshold distance). If not, at 330, it may be determined that the laser ignition device is still not installed in the cylinder and the laser device may be disabled again. The method may then return to 322 to reassess the position following a subsequent reset input. If the distance is within the threshold distance, then at 324, it may be inferred that the laser ignition device has been reinstalled in the cylinder, and accordingly, the laser device may be re-enabled (to enable cylinder combustion ignition or cylinder piston position determination).

In alternate examples, in lieu of waiting for a subsequent reset input, the laser ignition device may be temporarily re-enabled to the lower power output at predefined durations since the first reset input (at 322) and the laser device may be enabled once the distance to the piston is determined to be within the threshold distance. Further still, in some embodiments, it may be required that all cylinders be within the threshold range before high-power re-enablement of any cylinder's laser following a removal event.

In this way, the method of FIG. 3 enables operation of the laser ignition device when the inferred position of the device is in the cylinder and disabling operating of the device when the inferred position is out of the cylinder. By adjusting the operation, or power output, of the device based on the inferred position of the device relative to a piston of the cylinder, potential injuries and accidents that may occur due to mishandling of the laser while the laser is outside of the cylinder can be reduced.

Now turning to FIG. 4, map 400 shows an example disabling of a laser ignition device coupled to an engine cylinder in response to an indication of removal of the device from the cylinder. Map 400 depicts engine operation (on or off) at plot 402, a laser power level of the laser ignition device at plot 404, and an estimated distance between the laser ignition device and the piston at plot 406. As such, all the plots depict conditions for a given engine cylinder.

Prior to t1, the engine may be running and combusting. Due to ignition conditions being met, prior to t1, the laser ignition device may be operated at the higher power level to provide sufficient laser energy to ignite an air-fuel mixture in the cylinder. As such, during combustion conditions, the piston position is not measured. However, if it were, the piston position would continually shift within a range between a first position where the piston is at BDC, and a second position where the piston is at TDC (as shown by dotted segment 407). It will be appreciated that while the dotted segment is shown in the shape of a rectified sine wave, in alternate examples, it may be represented by a sine wave. At t1, the engine may be shutdown. For example, engine idle-stop conditions may be confirmed and engine fuel and spark may be deactivated.

During the non-combusting conditions following t1, the laser ignition device may be operated at the lower power level to provide sufficient laser energy to determine the position of the piston in the cylinder and estimate a distance from the piston to the laser ignition device. As such, between t1 and t2, the estimated distance may remain within a range (or threshold distance) that is based on distances estimated when the piston is at BDC and at TDC (see upper and lower limit at dashed lines).

At t2, a service technician may remove the laser ignition device from the given cylinder to test and diagnose it. As a result, at t2, the estimated distance between the laser ignition device and the piston of the cylinder may be outside of the range and higher than the threshold. In response to the distance being higher than the threshold, an engine controller may infer removal of the laser ignition device and disable the device. That is, the device may be disabled such that even if a laser pulse generation request is received, no laser pulse is emitted.

At t3, the service technician may return the laser ignition device to the cylinder and press a reset button. In response to the reset input from the operator, the laser ignition device may be temporarily operated in the lower power mode with a quick and short firing of laser pulses to confirm the installation of the laser ignition device in the cylinder. Between t3 and t4, the short laser pulse may be emitted and upon reflection off the top surface of the cylinder piston, may be detected. The distance between the piston and the laser ignition device may be estimated and determined to be within the range and lower than the threshold. In response to the estimated distance being within the range, at t4, it may be inferred that the laser ignition device has been installed into the cylinder, and the laser ignition device may be re-enabled to the lower power mode.

During the non-combusting conditions following t4, the laser ignition device may be operated at the lower power level to provide sufficient laser energy to determine the position of the piston in the cylinder. At t5, an engine restart condition may be confirmed responsive to which cylinder combustion may be initiated. Accordingly, at t5, the laser ignition device may be returned to the higher power mode. In addition, the piston position may resume continual shifting within the range as the piston moves between BDC and TDC (as shown by dotted segment 408).

In this way, a laser ignition device of an engine laser ignition system may be disabled when the laser device is removed from the engine. By inferring removal based on a measured distance between the piston of an engine cylinder and the laser ignition device, the optics of the laser ignition system that are already used to for engine position determination can be advantageously used to indicate the removal. By disabling the laser device so that no laser pulse is emitted even when a command to emit a laser pulse is received, potential injuries and accidents from mishandling of the high power laser device outside of the cylinder can be reduced. The laser device can be re-enabled only upon re-installation of the device into the cylinder. In this way, a safety interlock mechanism can be provided using the existing components of the laser ignition system.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine method, comprising:

operating a laser ignition device of a cylinder in a low power mode to infer a distance between the laser ignition device and a piston of the cylinder; and adjusting a power output of laser pulses emitted by the laser ignition device into the cylinder based on the inferred distance relative to a threshold, the threshold based on a length of the cylinder, wherein adjusting the power output includes maintaining operation of the device in the low power mode when the inferred distance is within the threshold, and reducing the power output of the laser pulses when the inferred distance is outside the threshold.

2. The method of claim 1, further comprising:

reading a barcode located on a top surface of the piston; and indicating that the laser ignition device has been removed from the cylinder.

3. The method of claim 1, wherein reducing the power output of the laser pulses includes disabling operation of the device.

4. The method of claim 3, wherein the adjusting includes reducing the power output of the laser pulses in response to the inferred distance indicating the device is removed from the cylinder.

5. The method of claim 1, wherein the inferred distance is based on a time elapsed since emission of a laser pulse from the laser ignition device into the cylinder and detection of the laser pulse following reflection off the piston.

6. The method of claim 1, wherein the threshold is further based on a distance between the laser ignition device and the piston when the piston is at a bottom dead center position and a distance when the piston is at a top dead center position.

7. The method of claim 1, further comprising:

operating the laser ignition device of the cylinder in a high power mode to initiate cylinder combustion responsive to the inferred distance for all engine cylinders being within the threshold.

8. An engine method, comprising:

operating a cylinder laser ignition device to estimate a distance between the laser ignition device and a piston of a cylinder; and disabling the laser ignition device in response to the estimated distance being larger than a threshold distance.

9. The method of claim 8, wherein the threshold distance is based on a length of the cylinder.

10. The method of claim 9, wherein disabling the laser ignition device includes disabling a laser emitter of the device.

11. The method of claim 10, wherein operating the laser ignition device to estimate the distance includes operating the laser ignition device at a lower power, the laser ignition device operated at a higher power when operating the laser ignition device to ignite a cylinder air-fuel mixture.

12. The method of claim 11, wherein the operating includes operating the laser ignition device before a first combustion event from rest.

13. The method of claim 8, wherein the operating to estimate the distance includes, emitting a low power laser pulse from the device towards an interior of the cylinder, the emitted laser pulse reflected off the piston;

detecting the reflected laser pulse; and estimating the distance based on a time elapsed between the emitting and the detecting.

14. The method of claim 13, wherein the threshold distance is based on a time elapsed when the piston is at bottom dead center.

15. The method of claim 14, further comprising indicating removal of the laser ignition device from the cylinder in response to the estimated distance being larger than the threshold distance.

16. The method of claim 15, wherein a top surface of the piston includes a barcode, the method further comprising reading the barcode to identify the cylinder from which the laser ignition device is removed.

17. A method for an engine, comprising:

disabling a laser ignition device coupled to an engine cylinder in response to an indication of removal of the device from the cylinder, wherein the indication includes a measured distance between a piston of the cylinder and the laser ignition device being higher than a threshold.

18. The method of claim 17, wherein disabling the laser ignition device includes, upon receiving a command to emit a laser pulse, emitting no laser pulse.

19. The method of claim 17, wherein disabling the laser ignition device includes disabling via hardware and/or software adjustments.

20. The method of claim 17, further comprising maintaining the laser ignition device disabled until an indication of installation of the device into the cylinder is received, and then re-enabling the laser ignition device.

* * * * *